US006155661A

United States Patent [19]

O'Neil et al.

[11] Patent Number: 6,155,661

[45] Date of Patent: Dec. 5, 2000

[54] DRAWER SLIDE LATCH

[75] Inventors: Kevin O'Neil, Cambridge; Kenneth R. Sawatzky, Kitchener, both of Canada

[73] Assignee: Waterloo Furniture Components Ltd., Canada

[21] Appl. No.: 08/929,021

[22] Filed: Sep. 15, 1997

(Under 37 CFR 1.47)

Related U.S. Application Data

[63] Continuation-in-part of application No. 08/449,808, May 24, 1995, Pat. No. 5,671,988.

[51] Int. Cl.[7] ..... A47B 88/04

[52] U.S. Cl. ..... 312/334.44; 312/333

[58] Field of Search ..... 312/334.44, 333

[56] References Cited

U.S. PATENT DOCUMENTS

| | | | |
|---|---|---|---|
| 2,125,619 | 8/1938 | Parent | 312/333 |
| 4,370,007 | 1/1983 | Fler | 312/333 |
| 5,292,198 | 3/1994 | Rock et al. | 312/333 X |
| 5,580,139 | 12/1996 | Grabher | 312/333 |

FOREIGN PATENT DOCUMENTS

| | | | |
|---|---|---|---|
| 2707365 | 8/1978 | Germany | 312/334.44 |
| 2081071 | 12/1982 | United Kingdom | 312/333 |

*Primary Examiner*—Peter M. Cuomo
*Assistant Examiner*—David E. Allred
*Attorney, Agent, or Firm*—Banner & Witcoff, Ltd.

[57] ABSTRACT

The present invention relates to a drawer slide assembly with an integral latch mechanism to inhibit inadvertent opening of a drawer. The structure of the present invention comprises an outer slide member and an inner slide member. The inner slide member is slidably engaged to the outer slide member. The structure includes an aperture in one of the slide members. A bearing is positioned to removably engage the aperture when the drawer slide assembly is in the closed position thereby forming a latch detent mechanism. The bearing is resiliently seated in a bearing retaining structure mounted on the drawer slide structure. The bearing retaining structure is provided with an element for providing a biasing force onto the bearing. This biasing force urges the bearing toward engagement with the aperture. When the bearing engages the aperture the inner slide member is held against slidable movement with respect to the outer slide member. This engagement provides for a secure latch to hold a drawer against inadvertent opening. The force necessary to disengage the latch is dependant upon the biasing force put upon the bearing.

7 Claims, 4 Drawing Sheets

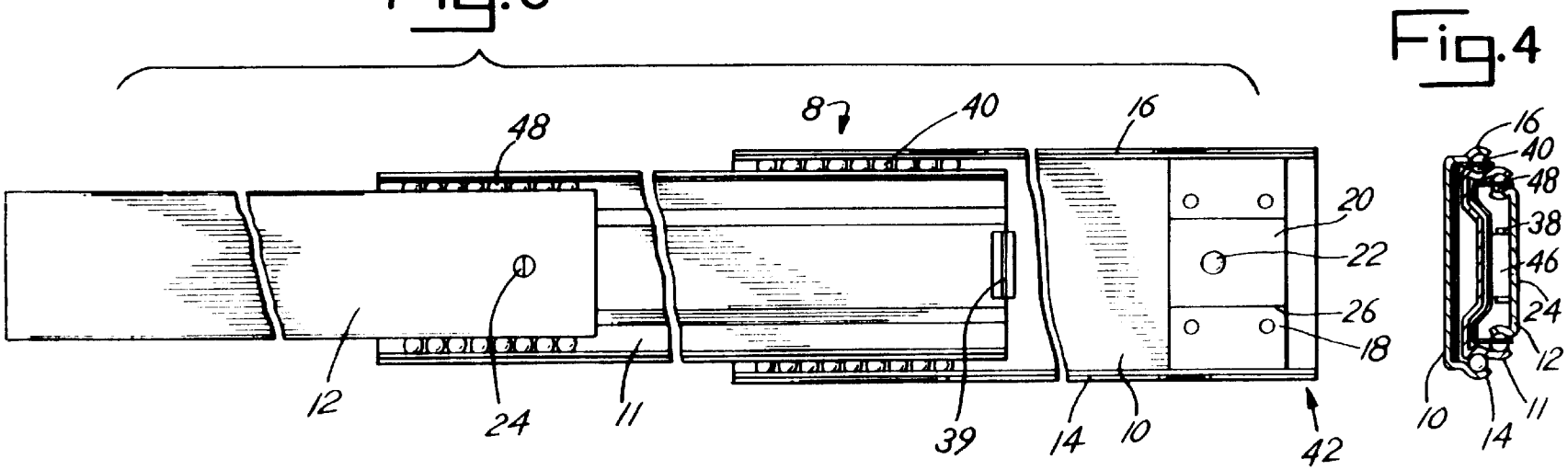
Fig. 4
Fig. 3
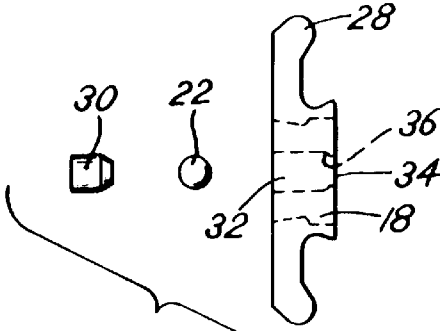
Fig. 6

FIG. 9
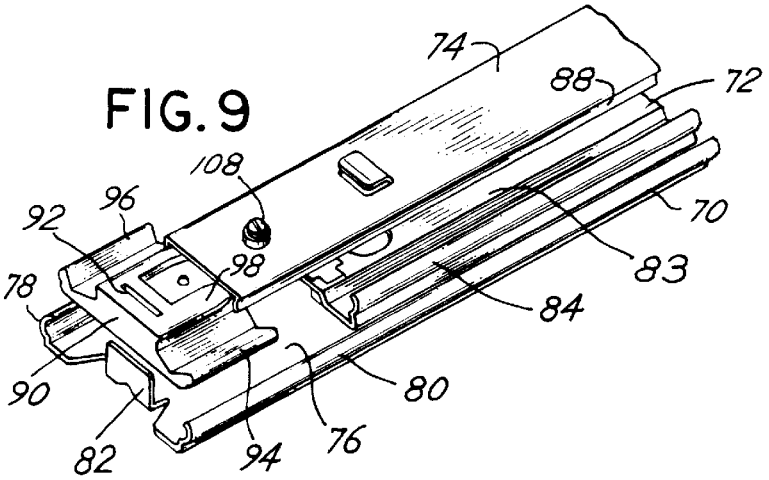
FIG. 11
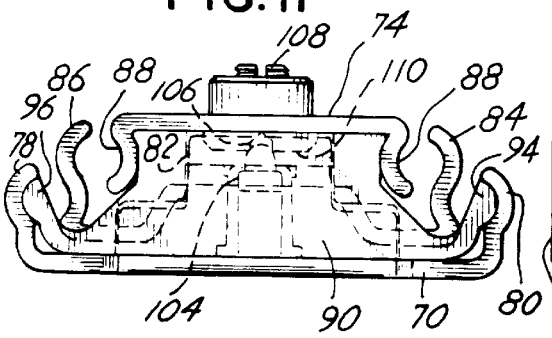
FIG. 10
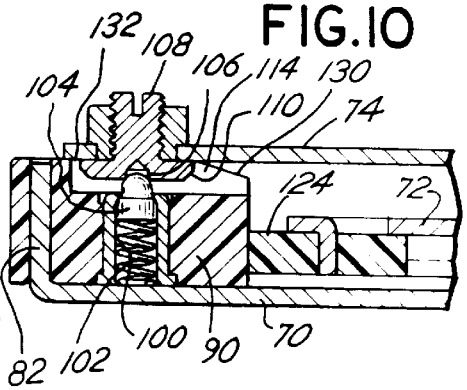
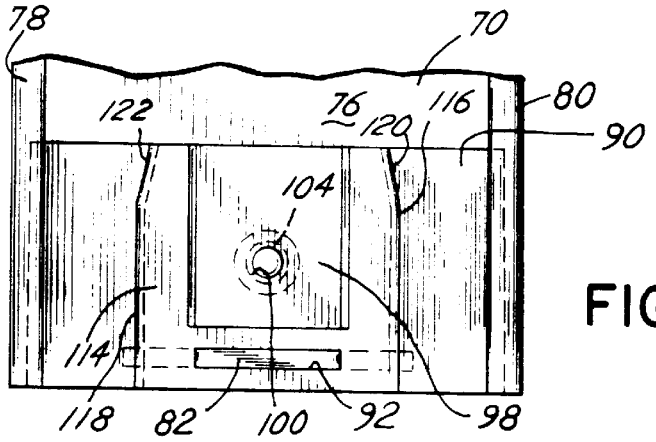
FIG. 12

DRAWER SLIDE LATCH

CROSS REFERENCE-RELATED APPLICATION

This is a continuation-in-part application of Ser. No. 08/449,808, filed May 24, 1995, now U.S. Pat. No. 5,671, 988, for which priority is claimed and which is incorporated herewith by reference.

BACKGROUND OF THE INVENTION

1. Field of the Invention

The present invention relates to the field of drawer slides of the type used in file cabinets, desks and tool boxes. More precisely the present invention relates to drawer slides that are adapted to prevent the drawer from unintentionally opening.

2. Description of the Prior Art

Drawer slides are designed to function with a minimum amount of friction as a drawer is opened and closed. Such operation allows drawers that are filled with heavy materials to be opened and closed with minimal effort. Unfortunately, this has resulted in a situation where drawers sometimes open when they are not intended to open. This phenomenon is especially prevalent in file cabinet and tool boxes that are designed to be mobile. Specifically, as the cabinet is moved the drawers tend to open. Unintentional and unwanted opening can also occur if the drawer cabinet is not level.

The prior art utilizes several different mechanisms which attempt to address this problem. One such mechanism includes a claw type latch device, constructed from plastic materials, devised to latch onto protrusions in the slide for the purpose of keeping the drawer closed. Another mechanism, designed to prevent drawer rebound, can also have the effect of latching the drawer. Such a device is shown in U.S. Pat. No. 4,932,792. A third mechanism, which utilizes a complex spring cam device designed to prevent drawer rebound, may also have some drawer latching qualities. Such a device is currently sold by Anchor Slide Company of the Netherlands. Each of these structures, however, has problems associated with them with respect to the desirability for using them to address the problem of unintentional drawer opening. These problems include—relatively low resistance to drawer opening, the structures require a large amount of space, the moving latches are subject to wear and breakage and the complex structure adds significantly to assembly and material cost.

There remains a need for a drawer slide that can reliably and economically keep a drawer from unintentionally opening.

SUMMARY OF THE INVENTION

The present invention relates to a drawer slide assembly with an integral latch mechanism to inhibit inadvertent opening of a drawer. The structure of the present invention comprises an outer slide member and an inner slide member. The inner slide member is slidably engaged to the outer slide member. The structure includes an aperture in one of the slide members. A ball bearing is positioned to removably engage the aperture when the drawer slide assembly is in the closed position. The ball bearing is resiliently seated in a ball bearing retaining structure mounted on the drawer slide structure. The ball bearing retaining structure is provided with means for providing a biasing force onto the ball bearing. This biasing force urges the ball bearing toward engagement with the aperture. When the ball bearing engages the aperture the inner slide member is held against slidable movement with respect to the outer slide member. This engagement provides a secure latch to hold a drawer against inadvertent opening. The force necessary to disengage the latch is dependant upon the biasing force put upon the ball bearing.

The advantages of the present invention over the mechanisms of the prior art are many. Most importantly the present invention provides a simple and effective mechanism for the prevention of unintentional opening of drawers. Therefore, mobile file cabinets and tool boxes can be safely and rapidly moved without the inconvenience and danger of a drawer sliding open, while, at the same time, there is no need to latch and unlatch a cumbersome mechanism. The present invention provides an integral latch that engages when the drawer is closed.

It is a further advantage of the present invention to provide a latch that secures a drawer without the need to do anything but close the drawer. Therefore, there is no conscious effort necessary to secure the drawer.

It is an object of the present invention to provide a drawer slide assembly with an integral latch that will retain a drawer in the closed position against unintentional opening.

It is a further object of the present invention to provide a drawer slide assembly with an integral latch that can be disengaged simply by supplying reasonable force when pulling the drawer open. The requisite force is not excessive but it is more force than will be the result of either centrifugal force or jostling from the movement of a mobile file cabinet or tool chest.

It is yet a further object of the present invention to provide a drawer slide assembly with an integral latch mechanism that will prevent unintentional and undesired opening of drawers when a file cabinet is positioned on an uneven surface or the drawer slides are not mounted level.

It is still a further object of the present invention to provide a drawer slide assembly with an integral latch wherein said integral latch comprises a ball bearing that is biased to engage an aperture in the drawer slide construction and when the ball bearing engages the aperture the drawer associated with the drawer slide is secured against inadvertent opening.

It is still a further object of the present invention to provide a drawer slide assembly with an integral latch that can be effective in both two member and three member drawer slides.

Yet another object of the invention is to provide a drawer slide wherein the tension between the separate slide members which telescopically interact may be adjusted.

Another object of the invention is to provide a drawer slide wherein the separate slide members comprising the telescoping slide construction are constructed to provide deceleration as the slide members telescope from an open position to a closed position.

These and other objects and advantages of the present invention will become evident from the following detailed description of the preferred embodiment.

BRIEF DESCRIPTION OF THE DRAWINGS

FIG. 3 is a side view of a three member drawer slide incorporating the present invention.

FIG. 4 is a cross section of the three member drawer slide incorporating the present invention.

FIG. 6 is an exploded cross section of the detent latch mechanism of the present invention.

FIG. 9 is an isometric view of an alternative embodiment of the invention including opposed slide members forming a drawer slide.

FIG. 10 is a side cross sectional view of the construction of FIG. 9.

FIG. 11 is an end view of the construction of FIG. 9.

FIG. 12 is a top plan view of one of the slide members positioned to interact with a longitudinally sliding, second slide member.

DETAILED DESCRIPTION OF THE PREFERRED EMBODIMENT

The present invention relates to an improved drawer slide assembly of the type used in cabinets and tool boxes. These drawer slide assemblies are basically of two types: (1) a two part slide assembly, and (2) a three part slide assembly. The present invention is applicable to both types of assemblies.

Figure 1:
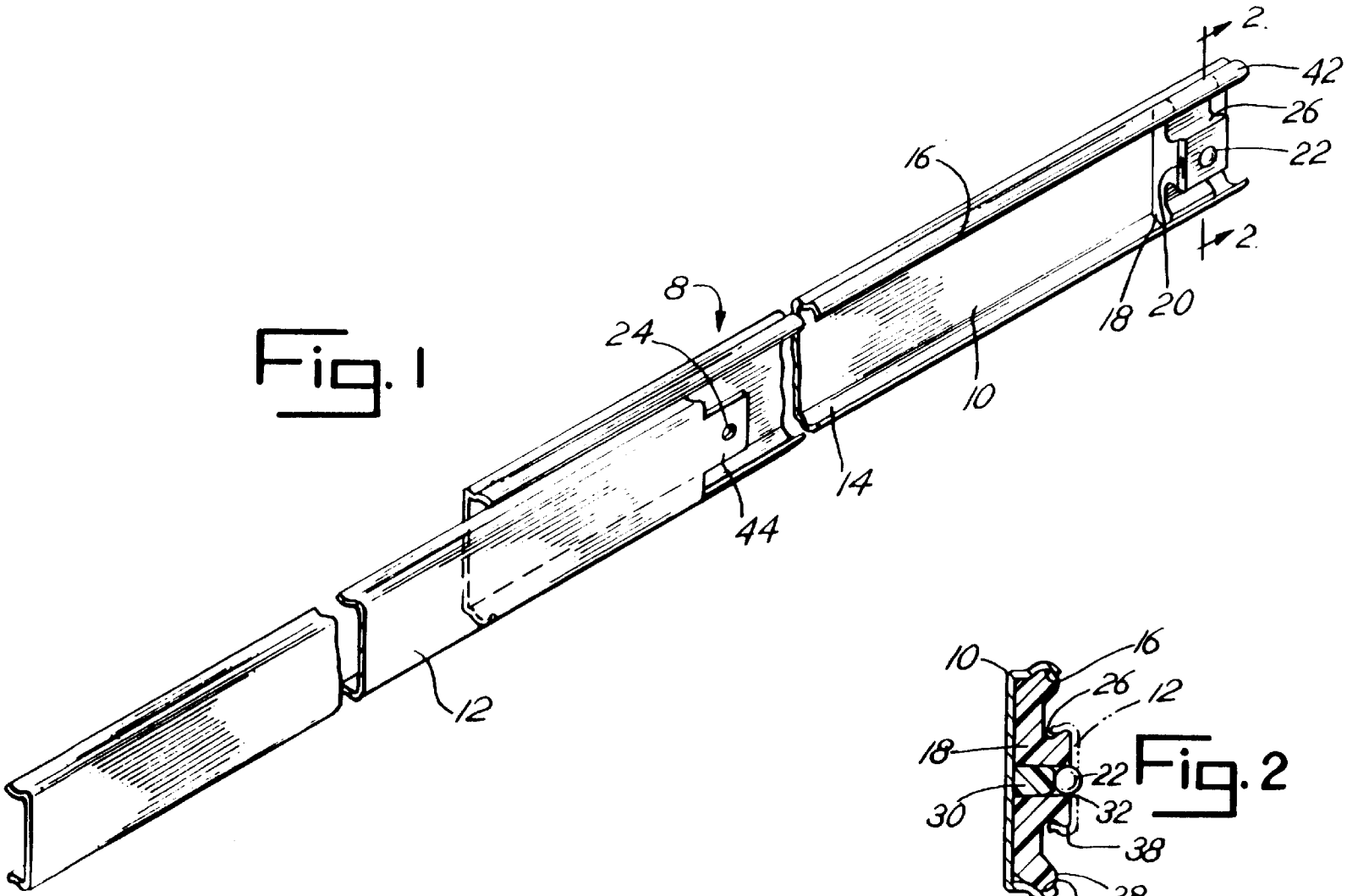
FIG. 1 is a perspective of a two member drawer slide incorporating the present invention.

A preferred embodiment of a two part slide assembly of the present invention is illustrated in FIG. 1. Referring to FIG. 1, a drawer slide assembly 8 comprises two slide members, an outer slide member 10 and an inner slide member 12. The inner slide member 12 is telescoped within the outer slide member 10 and is slidably engaged with the outer slide member 10. The outer slide member 10 includes a lower slot or channel 14 and an upper slot or channel 16. The channels 14, 16 are separated by a planar span 15 and are opposed to each other and define opposed parallel runways 13. Each of these channels 14, 16 support and engage a separate ball bearing race or retainer 40. The ball bearing race or retainer 40 is capable of moving in said runway 13. The inner slide member 12 includes parallel lateral edges which co-act with the ball bearings in the separate races 40 to permit the slide member 12 to freely slide with respect to the outer slide member 10. The ball bearing races or retainers 40 are generally of a shorter length than the inner slide member 12. Typically, the races 40 are positioned in the center portion of the inner slide member 12. The inner slide member 12 includes a tab 44 at one end extending beyond the travel of the ball bearing retainer 40. This tab 44 includes a pair of extending legs 38 projecting from the tab 44 toward the outer slide member 10 and defining a space 46 between them. The tab 44 also defines an aperture 24 into said space 46.

Referring further to FIG. 1 a ball bearing retaining structure 18 is mounted on the outer slide member 10. Preferably, the retaining structure 18 is mounted on the inner end 42 of the outer slide member 10. The structure 18 has a ball bearing 22 resiliently projecting from a passage or cavity 32 to form a latch detent mechanism. In the preferred embodiment of FIG. 1, the structure 18 also serves as a terminal bumper or stop member which acts to stop the slide motion of slide member 12 when the drawer is closed. The bumper or stop member structure 18 is preferably made of a rubber or elastomeric material giving it a resilient quality and sound deadening quality.

Figure 2:
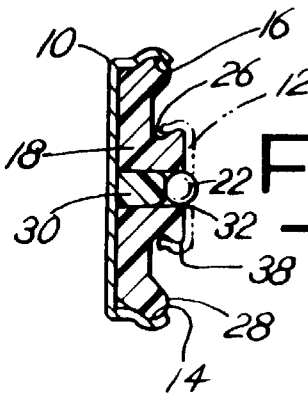
FIG. 2 is a cross section of FIG. 1 along line 2—2.

A cross section of the bumper structure 18 of FIG. 1 is shown in greater detail in FIGS. 2 and 6. As clearly shown in FIGS. 2 and 6, bumper structure 18 includes a central passage or cavity 32 with a circular opening 34. The cavity 32 is sized to house the ball bearing 22 and a urethane plug 30. The ball bearing 22 extends partially through the opening 34 and is biased outwardly by the plug 30. The circular opening 34 has a diameter less than the diameter of cavity 32 and the ball bearing 22 so that less than half of the ball bearing 22 extends through the circular opening 34. The cavity 32 at the circular opening 34 also preferably thus includes arcuate circumferential rib or lip 36 shaped to retain the ball bearing 22 in cavity 32. The ball bearing 22 is provided with an outward bias by the urethane plug 30 located behind the ball bearing 22. Other mechanisms may be used to provide the biasing force and are well known in the art. For example a spring could replace the urethane plug 30. The urethane plug 30, however, has the advantage of providing precise control of the force applied upon the ball bearing 22. It is this biasing means that provides the ball bearing 22 with its resilient quality.

Preferably, structure 18 is also preferably shaped to operate within the drawer slide assembly. Specifically, in the preferred embodiments of FIGS. 1 and 2 the structure 18 includes at it outer ends a mating arm extension 28 sized to fit within the upper channel 16 and the lower channel 14. The structure 18 further includes a recessed channel midsection 20 which is shaped to receive the extending legs 38 of the tab 44 defined by the inner slide member 12. Specifically, the midsection 20 includes guideways 26 which receive the extending legs 38 of the inner slide member 12.

In another embodiment, the present invention is applicable to three member drawer slide assemblies as shown in FIGS. 3 and 4. In principal part the embodiment of FIGS. 3 and 4 are essentially the same as that shown in FIG. 1, with the exception that FIGS. 3 and 4 include an intermediate slide member 11 and an intermediate ball bearing retainer or race 48. The intermediate slide member 11 is telescoped within and slidably mounted on the outer slide member 10 and the inner slide member 12 is telescoped within and slidably mounted on the intermediate slide member 11. In the embodiment of FIG. 3 the ball bearing 22 engages the aperture 24 in a portion inner slide member 12 that extends beyond the end 39 of the intermediate slide member 11 when the slide assembly is in the closed position.

Figures 5, 7, 8:
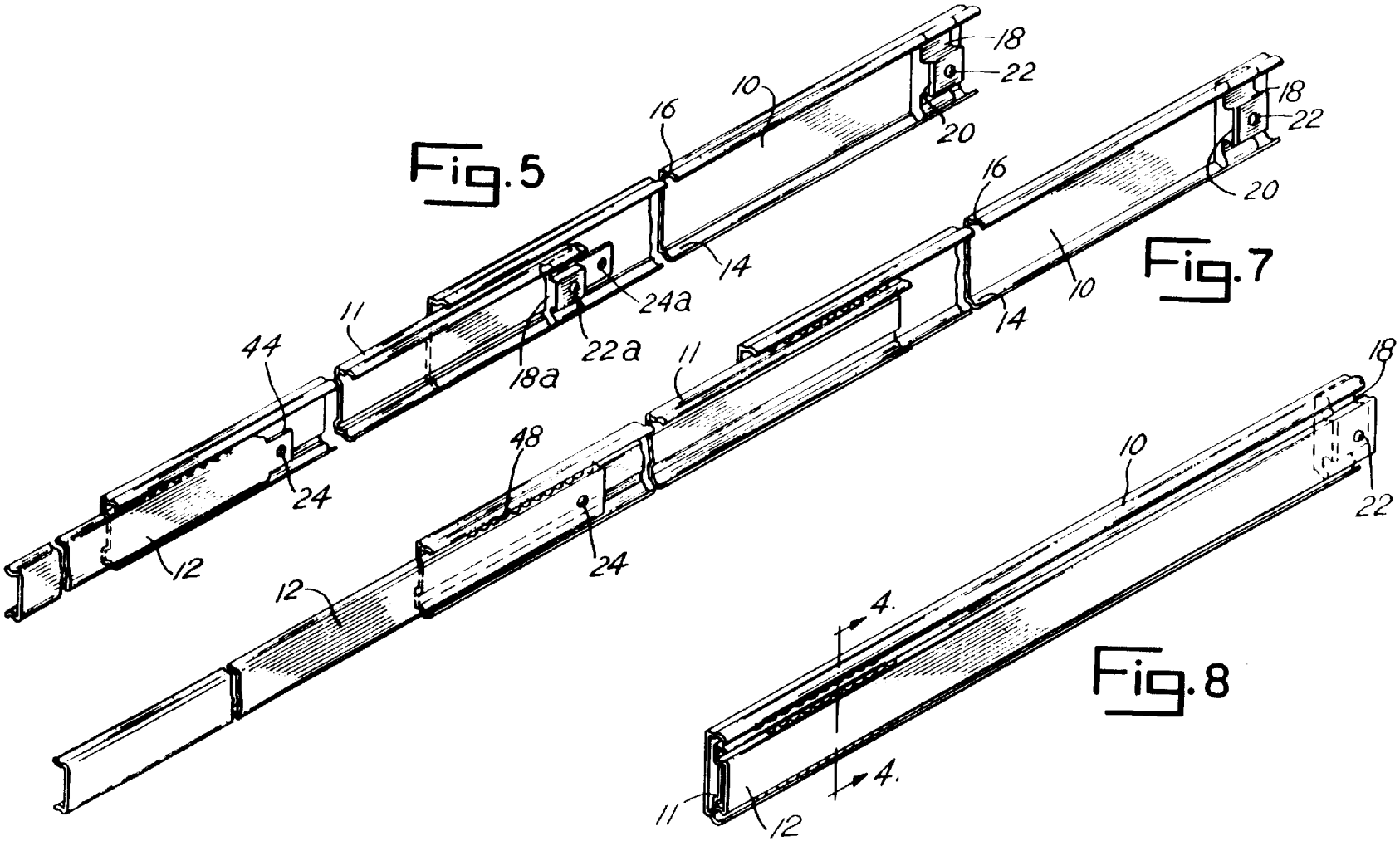
FIG. 5 is a perspective of a three member drawer slide illustrated a second embodiment of the present invention.
FIG. 7 illustrates a three member drawer slide incorporating the present invention in the open position.
FIG. 8 illustrates a three member drawer slide incorporating the present invention in the closed and latched position.

Alternative embodiments of the present invention are possible. One example is shown in FIG. 5 wherein the drawer slide structure includes two ball bearing retaining structures 18 and 18*a* located on the outer slide member 10 and the intermediate slide member 11 respectively. In such a construction the ball bearing 22 of the structure 18 engages an aperture 24*a* on the intermediate slide member 11 and the ball bearing 22*a* of the structure 18*a* engages the aperture 24 on the inner slide member 12.

It is further noted that in a preferred embodiment the structure 18 is located at the end of the slide members 10 and 11. This location, however, is not necessary. The ball bearings 22 and 22*a* could be located at a position intermediate the ends of the slide members 10, 11 as long as the slidable movement is not hindered. The end location, however, is especially preferred because it is believed to be the location that will cause the least noise and the least resistance when the drawer is opened and closed.

It will be appreciated by one skilled in the art that substitutions can be made in the preferred embodiments discussed above. For example, the ball bearing retainer or race 40 can be replaced with rollers in an appropriate drawer slide assembly. Likewise, the position of the aperture 24 and ball bearing 22 can be reversed, i.e., mounting the ball bearing 22 on the inner slide member 12. Such modifications of the preferred embodiment are well within the skill of one skilled in art and within the spirit and scope of the present invention.

In operation the present invention acts to latch a drawer in the closed position. Such operation is illustrated in FIGS. 7 and 8. FIG. 7 shows a three member drawer slide assembly expanded in the open position. FIG. 8 illustrates a three member drawer slide assembly in the closed and latched position. When the drawer is closed the ball bearing 22 engages the aperture 24. This engagement keeps the drawer closed. The drawer is opened simply by pulling the drawer with sufficient force to overcome the biasing force put upon the ball bearing 22 by the plug 30, thereby compressing the plug 30 and causing the ball bearing 22 to disengage the aperture 24.

FIGS. 9 through 12 illustrate another alternative embodiment of the invention. Referring to these figures, the drawer slide includes a first or inner slide member 70, an intermediate slide member 72 as well as an outer slide member 74. Thus in the embodiment shown, there are three separate telescoping slide members 70, 72 and 74, each of which interact one with the other in a telescoping fashion to provide a means for supporting a drawer (not shown). The drawer (not shown) is attached to the outer slide member 74. The inner slide member 70 includes a planar span 76 which extends between opposed side channels or longitudinal slide channels 78 and 80. The inside end of the slide member 70 includes an upwardly projecting tab 82.

The intermediate slide member 72 includes a planar or central span 83 which joins opposite longitudinal slide channels 84 and 86. The channels 84 and 86 include wings such as wing 88 which fits into the slide channel 78 of member 70 so that the intermediate slide member 72 can slidably and telescopically move with respect to the outside slide member 70. The channel 84 is adapted to receive and cooperate with the outside wings 88 of the outside slide member 74. Thus, the members 72 and 74 telescopically move one with respect to the other. The telescoping members 70, 72, 74 may include bearings or race constructions to facilitate telescopic movement.

An important feature of the invention relates, inter alia, to an elastomeric stop member 90 which includes a transverse slot 92 cooperative with the tab 82 to hold the stop member 90 in position against longitudinal movement within the slide member 70. The stop member 90 further includes side wings 94 and 96 which are shaped to fit respectively into the channels 78 and 80 to further locate the stop member 90. Additionally, the stop member 90 includes a mid section 98 with a recessed passageway 100 defined therein. A coil spring 102 is positioned between the planar span 76 and a bearing 104 which fits within the passageway 100. Note the passageway 100 has a constricted exit end so as to retain the bearing 104.

The bearing 104 is positioned to engage with a pocket 106 associated with a locking screw 108 that is adjustably mounted in the span 74. Thus when the span 74 is appropriately positioned so as to align the pocket 106 with the bearing 104, the bearing 104 will fit within the pocket 106 thereby providing a detent retention feature of the span 74 and thus slide members 70 and 72. The threaded screw 108 may be adjusted to adjust the tension or compression force with respect to the detent mechanism.

The mid section 98 is recessed in the region of the flanged head 110 of the adjustable screw mechanism so that the head 110 will not interfere with the engagement of the pocket 106 with the bearing 104. Spaced on opposite sides, however, of the opening 100 are ribs 112 and 114. The ribs 112 and 114 include depending sides 116 and 118. The leading edge 120 of depending side 116 and leading edge 122 of depending side 118 enables the side wings or flanges 88 of the slide member 74 to be centered on the elastomeric stop member 90 and thus to be appropriately aligned so that the pocket 106 will properly engage with the bearing 104 when the slide is moved from the open to the closed position.

It is also to be noted, as depicted in FIG. 10, that the intermediate slide member 72, which slides within the inside slide member 70, includes an elastomeric bumper 124 which engages against the stop member 90, thereby limiting the travel of the slide member 72. The stop member 90 thus has a dual function of providing a stop for the various slide members as well as a detent function with respect to the outside slide member 74 wherein the detent function is adjustable.

In this embodiment just described there are three telescoping slide members 70, 72 and 74. However, it is only necessary to utilize two slide members to practice the invention. Importantly, the elastomeric stop member 90 cooperates with the upstanding tab or tang 82 to thereby solidly position the slide member 90. Additionally it is possible to coin the edges of the channels 78 and 80 to further effect retention of the stop member 90 properly in position.

As another feature of the invention, the ribs 112 and 114 may be inclined with a ramp 130 as shown in FIG. 10 which leads to a land 132. The land 132 will then frictionally engage the middle span or web of the slide member 74 to retard motion thereof. This inhibits rebound that might result otherwise when closing and opening a drawer.

Preferred embodiments of the present invention have been described. The above description, however, is only illustrative of the invention and is not intended to limit the invention in spirit or scope. Only the following claims and their equivalents limit the scope of the invention.

What is claimed is:

1. A drawer slide comprising, in combination:

at least first and second telescoping slide members for slidable attachment of a drawer to a cabinet, said slide members each having a longitudinal planar span and longitudinal opposed channels extending in a telescoping direction between opposite ends of said slide members, the channels of one member slidably cooperative with the channels of the other slide member, and a detent latch for releasably maintaining the slide members in a fixed telescoping condition, said detent latch comprising:

an elastomeric stop member mounted in the one slide members at a fixed position, said stop member structure dimensioned to fit between the spaced, opposed channels of the one slide member and against the planar span thereof, said stop member structure having a mid-section located between the spaced, opposed channels, said stop member structure further including a passage in the mid-section, a bearing projecting from the passage away from the planar span of the one slide member, said passage including biasing means for biasing the bearing away from the planar span of said one slide member, said stop member structure defining a stop for limiting telescopic movement of the other slide member; and said other slide member including a detent aligned and engaged with the bearing in a detent releasable position when the other slide member is positioned over the bearing structure; and wherein the detent comprises an adjustable detent socket having a socket member adjustably threaded with respect to the planar span of the other slide member.

2. The slide of claim 1 wherein the adjustable socket member controls the engagement force with the bearing.

3. The slide of claim 1 wherein the elastomeric stop member includes a slot therein and the one slide member includes an integral projection tab extending from the one slide member into the slot to hold the elastomeric stop member in position.

4. The slide of claim 1 wherein the elastomeric stop member includes a mid-section having a width dimension substantially equal to the width dimension of the planar span of the other slide, said other slide further including lateral ribs extending from the planar span on opposite sides of the stop member mid-section, said mid-section thereby maintaining alignment of the telescoping slide members, detent and bearing.

5. The slide of claim 1 wherein the mid-section of the elastomeric stop member includes a raised portion extending away from the planar span of the one slide member to frictionally engage the planar span of the other slide member as the other slide member is telescoped over the stop member.

6. The slide of claim 3 wherein the tab extends from the planar span of the one slide member.

7. A drawer slide comprising, in combination:

at least first and second telescoping slide members for slidable attachment of a drawer to a cabinet, said slide members each including a longitudinal planar span having side edges, with longitudinal sliding mechanisms connecting the slide members together along the longitudinal edges of the planar span; said planar spans being spaced from one another and overlying one another as the slide members are telescoped between a drawer open and a drawer closed position;

an elastomeric stop member mounted on the planar span of one slide member within the space between the planar spans, said elastomeric stop member positioned to limit telescopic movement of one slide member over the other, detent means to provide releasable engagement of one slide member with the other in an engaged position;

said detent means including a socket comprising a screw adjustably threaded and supported on the stop member or an opposed slide member planar span, and further including a spring biased bearing in the other of the opposed slide member and the stop member, said bearing engaging a detent pocket in said screw in said engaged position.

* * * * *